US009364959B1

(12) United States Patent
Putrello, Jr.

(10) Patent No.: US 9,364,959 B1
(45) Date of Patent: Jun. 14, 2016

(54) SOLAR KNIFE

(71) Applicant: Andrew Carmen Putrello, Jr., Utica, NY (US)

(72) Inventor: Andrew Carmen Putrello, Jr., Utica, NY (US)

( * ) Notice: Subject to any disclaimer, the term of this patent is extended or adjusted under 35 U.S.C. 154(b) by 82 days.

(21) Appl. No.: 13/998,866

(22) Filed: Dec. 16, 2013

(51) Int. Cl.
*B26B 11/00* (2006.01)

(52) U.S. Cl.
CPC ..... *B26B 11/00* (2013.01)

(58) Field of Classification Search
CPC ..... B26B 11/00; B26B 11/008; B26B 3/00–3/08; B26B 5/00–5/008
USPC ..... 30/123–149, 151–163, 329–340, 30/342–344
See application file for complete search history.

(56) References Cited

U.S. PATENT DOCUMENTS 2,605,944 A * 8/1952 Maurice ..... 224/101
3,760,438 A * 9/1973 White ..... B25F 1/02 30/151
3,875,600 A * 4/1975 Reveaux ..... B25F 1/00 7/106
4,316,324 A * 2/1982 Cochran ..... B26B 11/00 30/162
4,363,147 A * 12/1982 Deweese ..... B25F 1/00 7/158
4,622,707 A * 11/1986 Finn ..... B26B 3/06 7/158
4,669,186 A * 6/1987 Liu ..... B26B 11/008 30/125
4,727,609 A * 3/1988 Smith, Jr. ..... B25F 1/02 7/158
4,753,377 A * 6/1988 Poluhowich ..... A44B 11/005 2/338
4,803,745 A * 2/1989 Izquierdo ..... B26B 29/025 30/151
4,821,356 A * 4/1989 Finn ..... F41C 27/18 30/342
4,882,841 A * 11/1989 Margolis ..... 30/125
4,944,392 A * 7/1990 Hull et al. ..... 206/102
5,214,853 A * 6/1993 Bray ..... B26B 11/00 30/183
5,398,360 A * 3/1995 Alexander ..... B26B 3/06 30/143
5,442,856 A * 8/1995 Moody ..... B26B 3/00 30/299
5,711,079 A * 1/1998 Fischer ..... B26B 5/00 30/342
5,924,233 A * 7/1999 Strobel ..... F41C 23/12 42/72
6,419,371 B1 * 7/2002 McCalla ..... B25B 23/18 362/109
6,782,576 B1 * 8/2004 Valencic et al. ..... 7/158
8,186,995 B2 * 5/2012 Putrello, Jr. ..... F23Q 1/06 148/401
8,202,085 B2 * 6/2012 Putrello ..... F23Q 1/06 7/158

(Continued)

FOREIGN PATENT DOCUMENTS

GB 2153283 A * 8/1985
GB 2171628 A * 9/1986

*Primary Examiner* — Jason Daniel Prone

(57) ABSTRACT

A solar knife that is used as a cutting or chopping tool that includes handle scales that have reflective shallow parabolic outside surfaces that can be used to ignite combustible materials using solar energy. The solar knife has a tinder holder blue print machined into its surface and also has an angled tinder holder mounting hole. Using the tinder holder blue print on the invention and the cutting edge of the solar knife, the user can fashion a precision tinder holder in the field using a tree branch or twig. The fashioned tinder holder is then inserted into the tinder holder mounting hole which allows the tinder to be held firmly at the exact focus of the parabolic outside surface of the handle scales where it is ignited using only energy supplied by the sun. The solar knife also includes sacrificial anodes to minimize metal oxidation.

10 Claims, 2 Drawing Sheets

(56) References Cited

U.S. PATENT DOCUMENTS 8,381,339 B2 * 2/2013 Knapp ..... B26B 3/00 30/138
8,672,135 B1 * 3/2014 Hymack ..... A47J 47/14 206/542
8,695,138 B2 * 4/2014 Pelton ..... B26B 11/006 30/161
8,707,490 B1 * 4/2014 Pelton ..... B26B 1/00 30/123
8,887,436 B1 * 11/2014 Putrello, Jr. ..... A01M 23/34 43/86
8,967,899 B1 * 3/2015 Chu et al. ..... 401/195
9,084,455 B2 * 7/2015 Millan ..... B26B 9/00 63/1.12
2002/0166238 A1 * 11/2002 Kaufer ..... B26B 13/22 30/125
2002/0184771 A1 * 12/2002 Kaufer ..... B26B 13/22 30/125
2005/0193564 A1 * 9/2005 Trbovich ..... B26B 3/00 30/124
2006/0080840 A1 * 4/2006 Freeman ..... B26B 3/06 30/151
2007/0044322 A1 * 3/2007 Trbovich, Jr. ..... B26B 3/00 30/294
2009/0000038 A1 * 1/2009 Padden ..... B25F 1/003 7/128
2010/0101095 A1 * 4/2010 Prasetya ..... B26B 11/008 30/123
2010/0186175 A1 * 7/2010 Watson ..... B25F 1/04 7/158
2013/0095439 A1 * 4/2013 Putrello, Jr. ..... F23Q 7/02 431/258
2015/0135768 A1 * 5/2015 Barrick ..... A44C 15/005 63/1.12
2015/0217461 A1 * 8/2015 Langenwalter ..... B26B 1/042 7/118
2015/0308686 A1 * 10/2015 Hensley ..... F41A 29/02 42/90
2015/0330781 A1 * 11/2015 Harris ..... A47G 21/04 7/164
2016/0046017 A1 * 2/2016 Wood ..... B26B 3/06 30/123

* cited by examiner

SOLAR KNIFE

FIELD OF THE INVENTION

The present invention relates to a solar knife, and, more particularly, to a solar knife having parabolic scales and a tinder holder arm blue print system that can be used to ignite combustible materials using solar energy.

BACKGROUND OF THE INVENTION

Knives and fire starters have been used for thousands of years and can be particularly useful during activities such as hunting, camping, and fishing. Knives and fire starters are very useful in situations where people are isolated from civilization where resources can be scarce. Knives come in many shapes and sizes but usually include a sharp cutting edge capable of cutting various materials and an area that can be used to hold the knife in one's hand during use. Fire starters use many types of ignition sources that include, matches, liquid or gas filled lighters, electrically heated elements, or pyrophoric elements, such as ferrocerium rods that are struck with sharp objects to produce a plurality of sparks. Matches, including water proof matches, do not work well in windy conditions, and provide minimum ignition time. Lighters use pyrophoric elements to ignite the on-board fuel source. Both lighters, and stand-alone pyrophoric type fire starters, all include elements that wear out over time, are susceptible to rapid oxidation in wet environments, are brittle and easily broken, require some means to scrape the pyrophoric element to obtain sparks, can be difficult to use, and contain rare earth elements, such as cerium, that are becoming too expensive to be practical. Fire starters that use electrically heated elements require batteries or other electrical sources that wear out and must be replaced or recharged. Both knives and fire starters can also be life saving devices in a survival situations such as when attacked by a wild animal or during natural disasters such as hurricanes, tornadoes, and floods. Often times in such natural disasters electrical service is lost and people must leave their homes and fend for themselves. Having a knife and a fire starter could save or improve the quality of lives. Ever since knives and fire starters have been used there has been a need for one invention that would provide both a reliable cutting tool and a non-consumable, non-electrical fire starting element to be used to ignite combustible materials in one portable, safe, durable device. The present invention addresses the aforementioned problems by using a structural design that is aimed at minimizing the negative effects thus increasing the likelihood that the individual will carry the tinder container solar powered fire starter and realize its benefits.

SUMMARY OF THE INVENTION

In accordance with the present invention, there is provided a solar knife that includes a full tang blade cutting tool that incorporates a forward tinder holder length reference groove that when coupled with the parabolic scale bottom and parabolic scale top of which the outside surfaces are machined parabolic reflectors that include a tinder holder reference groove aft form survival knife that is able to ignite combustible materials using only energy supplied by the sun. The elements and attributes of the solar knife combine to form and include a tinder holder blue print and angled tinder holder mounting hole. Using the tinder holder blue print on the invention, and the cutting edge of the full tang blade, the user can fashion a precision tinder holder in the field using a tree branch or twig. The fashioned tinder holder arm is then inserted into the angled tinder holder mounting hole until it bottoms out thus holding tinder at the exact focus of the parabolic outside surface of the handle scales where it is ignited using energy supplied by the sun. This eliminates the need to carry or stow a tinder holder thus providing a more light weight stream lined design than would otherwise be possible. The solar knife is also constructed using materials that act as sacrificial anode inserts that minimize corrosion of key components of the invention.

It would be advantageous to provide a solar knife that included a cutting blade and solar powered fire starter in once device It would also be advantageous to provide a solar knife that included a fire starting element that was non-consumable It would further be advantageous to provide a solar knife that included a fire starting element that uses solar energy from the sun or other stars to ignite combustible materials It would also be advantageous to provide a solar knife that included a full tang blade with a forward tinder holder length reference groove It would further be advantageous to provide a solar knife that included a full tang blade with forward and aft lashing holes It would also be advantageous to provide a solar knife that included scales that had shallow reflective parabolic outside surfaces It would further be advantageous to provide a tinder holder reference groove aft It would also be advantageous to provide an angled tinder holder mounting hole It would further be advantageous to provide a solar knife that included an index finger hold It would also be advantageous to provide a solar knife with counter sunk threaded scale mounting holes It would further be advantageous to provide a parabolic sale mounting screws with a standard reduction potentials more negative than the parabolic scales It would also be advantageous to provide a sacrificial anode is press fit into the parabolic scales that have a standard reduction potential more negative than the parabolic scales

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
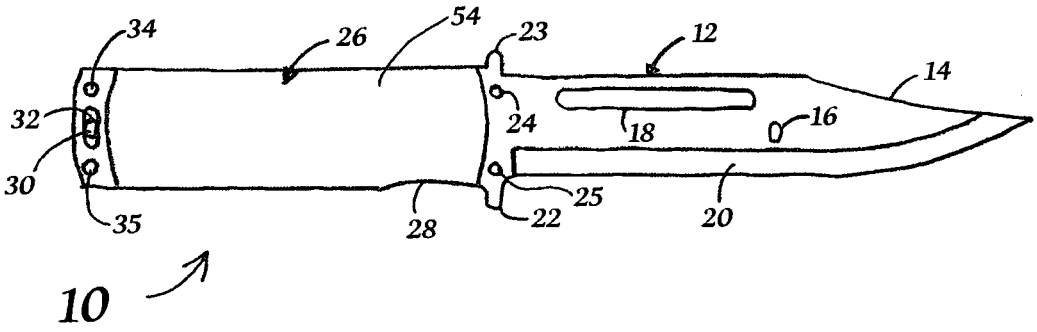
FIG. 1 is a side plan view of a solar knife in the non-firestarting configuration.

FIG. 1 is a side plan view of a solar knife 10 in the non-firestarting configuration.

Figure 2:
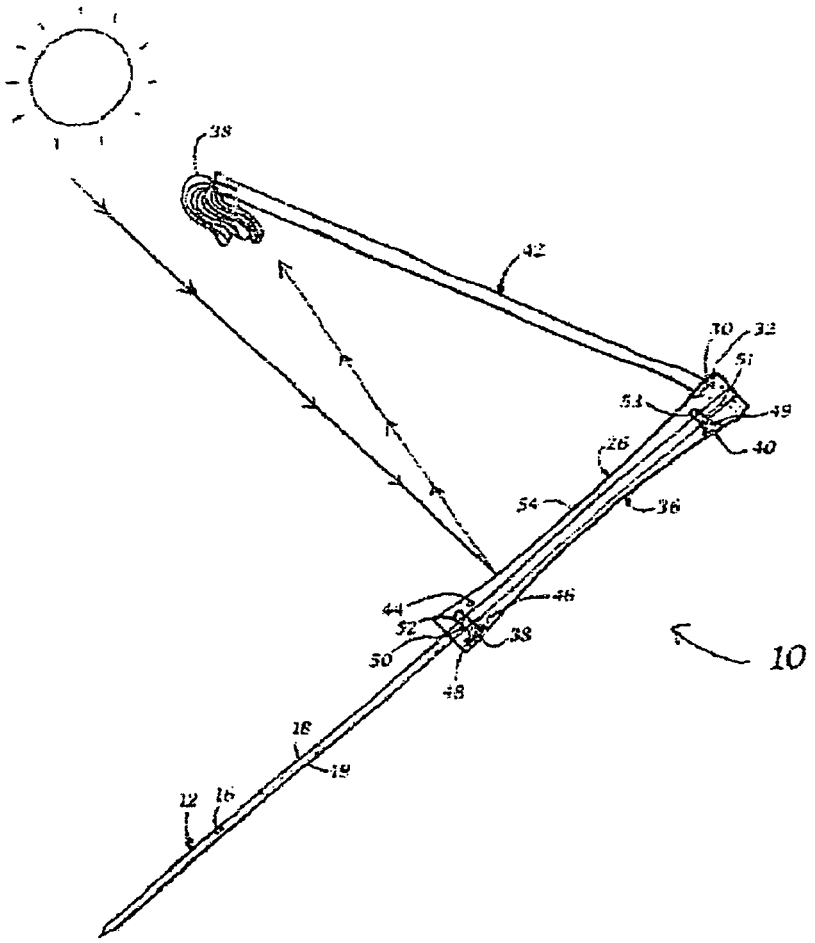
FIG. 2 is a top plan view of a solar knife in firestarting configuration.

FIG. 2 is a top plan view of a solar knife 10 in firestarting configuration with fashioned tinder holder inserted into position.

Referring to FIGS. 1 to 2 each element of the solar knife 10 is briefly described.

The solar knife 10 of the invention includes, a full tang blade 12 made from hardened steel or other suitable material and includes a forward tinder holder length reference groove 16, duel fuller grooves, one on each side, 18 and 19, forward lashing holes 24 and 25, double hilt 22 and 23, a sharpened edge 20 with clip point 14 and is removeably coupled with parabolic scale top 26 and parabolic scale bottom 36. Parabolic scale top 26 functions both as one side of the knife handle and also as a non-consumable solar fire starter. Parabolic scale top 26 has a reflective parabolic outside surface 54 that is used for fire starting and will be explained further below. Parabolic scale top 26 also includes a tinder holder length reference groove aft 32, angled tinder holder mounting hole 30, aft lashing holes 34 and 35, index finger hold 28, has an ergonomic shape, threaded mounting holes 52 and 53, and a first sacrificial anode insert 44. The first sacrificial anode insert 44 is firmly embedded into the parabolic scale top 26 by press fitting and has a standard reduction potential more negative than the material that is used to form the parabolic reflective surface 54 thus minimizing oxidation of the parabolic reflective surface 54 by acting as a sacrificial anode. Parabolic scale bottom 36 forms the other side of the handle and includes two counter sunk mounting screw through holes 48 and 49, index finger hold 28, a second sacrificial anode insert 46, and aft lashing holes 34 and 35. Two scale mounting screws are used to securely fasten the parabolic scale top 26 and parabolic scale bottom 36 to the full tang blade 12. Scale mounting screw 38 and scale mounting screw 40 and are also made from materials having a standard reduction potential more negative than the material used to manufacture reflective parabolic scale top 26 thus adding secondary protection against oxidation of the parabolic reflective surface by also acting as sacrificial anodes.

The parabolic scales are removeably coupled with the full tang blade 12 as follows, parabolic scale bottom 36 is equipped with two counter sunk through holes 48 and 49 to accommodate scale mounting screw 38 and scale mounting screw 40. The full tang blade 12 is also equipped with through holes 50 and 51 to accommodate scale mounting screw 38 and scale mounting screw 40. When assembling, through holes 50 and 51 position parabolic scale bottom 36 and parabolic scale top 26 at the proper location on the full tang blade 12 to insure proper mounting. Threaded bottom tapped blind holes 52 and 53 on parabolic scale top 26 are used to accept and securely fasten scale mounting screw 38 and scale mounting screw 40 once positioned into counter sunk through holes 48 and 49 of parabolic scale bottom 36 and guided by through holes 50 and 51 of the full tang blade 12, During assembly parabolic scale bottom 36 is placed on one side of the full tang blade 12 and parabolic scale top 26 is placed on the other side of full tang blade 12 forming an ergonomic handle in such a way as to allow scale mounting screw 1 38 and scale mounting screw 2 40 to pull both parabolic scale top 26 and parabolic scale bottom 36 towards each other thus securely fastening the scales to the full tang blade 12. Mounting the scales in this fashion provide a smooth uninterrupted surface on parabolic scale top 26 to maximize the reflection of photons toward the focus of the parabolic reflector.

In operation and referring to FIG. 1 to FIG. 2, the present invention provides a blue print and tool to fashion key components of the invention in the wilderness using only materials found in nature to complete the construction of the present invention thus eliminating the need to stow or carry equipment that may not be needed in every situation. To start a fire the user must cut a small branch or twig from a tree. Next the user places the small branch or twig on the solar knife 10 positioning one end of the small branch or twig at the aft edge of the tinder holder length reference groove aft 32. Next the user marks the small branch or twig at the tinder holder reference groove 16. Next the user cuts the small branch or twig using the sharpened edge 20 of the full tang blade 12. Next the user splits the end of the small branch or twig 42 and then spreads the split section of the small branch or twig apart and wedges leaves or other suitable fire starting tinder 38 into the split section of the small branch or twig 42 using the full tang blade 12. The user then shaves off material from the outside surface of the other end of the small branch or twig until it can be securely pressed into and bottomed out in the angled tinder holder mounting hole 30. This now forms a complete tinder holder 36 that holds the firestarting tinder at the exact focus of the parabolic reflective surface 54 of parabolic scale top 26. Next the user aims the solar knife 10 towards the sun. All photons from the sun are reflected off of the parabolic scale top 26 reflective surface 54 and directed to a singular point of focus that corresponds to the end of the fashioned tinder holder 36 made from a small branch or twig thus concentrating the suns energy and igniting combustible materials using only energy supplied by the sun. The parabolic scale top 26 has a shallow parabolic surface and very long focal length as to allow use of a longer tree branch or twig that could then be used to safely place the burning ember ignited by energy from the sun into a larger tinder pile without the risk of burning one's hands while simultaneously serving as initial fire starting tinder itself.

Now referring to FIG. 1 the solar knife 10 is shown in non-firestarting configuration. In this configuration the solar knife 10 can be used to cut or chop materials using the sharpened edge 20. The solar knife 10 is also equipped with forward lashing holes 24 and 25 and aft lashing holes 34 and 35 that can be used along with parachute chord, twine, or other lashing materials to mount the solar knife 10 onto a long notched tree branch to form a spear that can then be used to fend off predators such as bears in emergency survival situations. The hilts of the full tang blade 12 22 and 23 together with index finger hold 28 prevent the users hands from sliding forward during a thrusting motion like one that would be used in self defense or combat situations.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A solar knife comprising: a knife blade including a cutting portion defining a sharp cutting edge and an elongate extending tang defining a longitudinal axis, a first knife handle scale attached to the tang to define a knife handle, the first knife handle scale having a sacrificial anode insert embedded therein, an oblique aperture that defines an aperture axis that is oblique to the longitudinal axis of the knife blade, and a reflective parabolic outer surface, the reflective parabolic outer surface reflects sunlight to a focal point, and the aperture axis substantially intersects the focal point so that when a substantially straight combustible work piece is received by the oblique aperture, the substantially straight combustible work piece will interact with the reflected sunlight at the focal point to ignite the substantially straight combustible work piece.

2. The solar knife of claim 1, further comprising a second knife handle scale attached to a side of the tang opposite the first knife handle scale to further define the knife handle.

3. The solar knife of claim 2, the second knife handle scale having a second sacrificial anode insert embedded therein, a second oblique aperture that defines a second aperture axis that is oblique to the longitudinal axis of the knife blade, and a second reflective parabolic outer surface, the second reflective parabolic outer surface reflects sunlight to a second focal point, and the second aperture axis substantially intersects the second focal point so that when a substantially straight combustible work piece is received by the second oblique aperture, the substantially straight combustible work piece will interact with the reflected sunlight at the second focal point to ignite the substantially straight combustible work piece.

4. The solar knife of claim 3, the first and second knife handle scales each having two lashing holes and/or a finger receiving groove.

5. The solar knife of claim 2, further comprise two screws, each of the first and second knife handle scales have two threaded bores, the tang has two holes, and each of the screws is received by a respective one of the bores in each of the first and second knife handle scales and is received by a respective one of the holes in the tang to define the attachment between the scales and the tang.

6. The solar knife of claim 5 the screws are made from a material that allows for the screws to act as sacrificial anodes that add protection against oxidation of the reflective parabolic outer surfaces.

7. The solar knife of claim 5, the two threaded bores of one of the first and second knife handle scales are countersunk.

8. The solar knife of claim 1, the knife blade is made of a hardened stainless steel material.

9. The solar knife of claim 1, the cutting portion has a tinder holder groove and/or a clip point and/or a double hilt and/or two lashing holes, and/or an elongated fuller groove on each side of the cutting portion.

10. The solar knife of claim 1, the first knife handle scale having two lashing holes and/or a finger receiving groove.

* * * * *